US005862938A

United States Patent [19]

Burkett

[11] Patent Number: 5,862,938

[45] Date of Patent: Jan. 26, 1999

[54] FLAT BOTTOM COMPOSITE PRESSURE VESSEL

[76] Inventor: Jerald S. Burkett, 8115 Calland Rd., West Liberty, Ohio 43357

[21] Appl. No.: 885,545

[22] Filed: Jun. 30, 1997

[51] Int. Cl.[6] ..... B65D 7/44

[52] U.S. Cl. ..... 220/592; 220/589; 220/628; 220/636; 220/62.19

[58] Field of Search ..... 220/587, 588, 220/589, 592, 590, 591, 628, 636, 632, 62.19

[56] References Cited

U.S. PATENT DOCUMENTS

| | | | |
|---|---|---|---|
| 1,719,473 | 7/1929 | Hron | 220/636 |
| 3,073,475 | 1/1963 | Fingerhut | 220/3 |
| 3,557,827 | 1/1971 | Marsh | 220/592 |
| 3,692,601 | 9/1972 | Goldsworthy et al. | 220/592 |
| 3,843,010 | 10/1974 | Morse et al. | 220/3 |
| 3,874,544 | 4/1975 | Harmon | 220/3 |
| 4,053,080 | 10/1977 | Daublebsky | 220/592 |
| 4,438,858 | 3/1984 | Grover | 220/3 |
| 5,287,987 | 2/1994 | Gaiser | 220/589 |
| 5,474,206 | 12/1995 | Herring, Sr. | 220/636 |
| 5,758,796 | 6/1998 | Nishimura | 220/592 |

*Primary Examiner*—Joseph M. Moy
*Attorney, Agent, or Firm*—Biebel & French

[57] ABSTRACT

A lined composite pressure vessel is adapted for mounting in upright position on a flat surface or the like in which a filament wound pressure vessel has a polar closed end and is formed with a liner. An end boss extends through the closed end with an annular skirt positioned adjacent to an outside surface of the liner in which the skirt is encapsulated by the filament windings of the pressure vessel. The end boss has a generally axial portion extending from the skirt forming an outwardly opening annular recess, the recess having an outer knurled surface, and receives therein winding filaments of the pressure vessel body so that the end boss is encapsulated in place. A face portion of the end boss is provided with a means by which a support platform may be mounted on the end boss for supporting the torsional and bending stresses are distributed by the end boss over a substantial area of the pressure vessel.

4 Claims, 2 Drawing Sheets

FLAT BOTTOM COMPOSITE PRESSURE VESSEL

BACKGROUND OF THE INVENTION

This invention relates to a lightweight composite pressure vessel, such as a filament wound pressure tank. A flat bottom to a pressure vessel is provided without sacrificing the weight savings inherent in the composite design.

It is common practice for pressure vessels in the form of industrial gas cylinders to be manufactured with flat bottoms enabling the cylinders to stand upright for filling and general use. These industrial gas cylinders typically contain various gases under pressure (argon, acetylene, nitrogen, oxygen, etc.). The vast majority of these cylinders are constructed from steel and aluminum.

In weight critical applications, aluminum cylinders have dominated steel in recent years for market share. One example is an oxygen cylinder for the medical industry. However, composite cylinders offer an even greater weight savings and have the highest performance factor as compared to steel and aluminum. Performance factor is defined as PV with P=operating pressure, V=internal volume (water capacity), W=weight of vessel at 0 psig.

Although steel and aluminum cylinders have flat bottoms designed into them to allow them to stand upright, they have low performance factors. Contributing to their poor performance factor (heavy cylinder design) is the design philosophy of the flat bottom itself. By exposing the flat bottom (as typical in industrial gas cylinder design) to the internal pressure, a massive thickness of material is required to resist the high stresses caused by the flat geometry. This results in an extremely heavy cylinder, with the majority of the weight being in the design of the bottom itself. This phenomenon is demonstrated through the simple stress equation for a homogeneous material membrane stress for pressure vessels $\rho=PR$, with $\sigma$=stress, T=thickness of material, and R=radius of curvature. As one can see as the radius of curvature gets larger ($R\rightarrow\infty$, for flat geometry) the stresses increase dramatically therefore, T=thickness must increase alto to keep the $\sigma$=stress reasonably below the material allowable stress.

While composite cylinders seem the logical choice in the medical industry to replace aluminum, the market share has been extremely limited at best. The limited use of composite cylinders in this industry is due to several factors. One major factor is the lack of a flat bottom on existing composite cylinder designs. There exists a need for a flat bottom without sacrificing the structural efficiency already known and established in the art of composite pressure vessel design and manufacturing. Such devices must have sufficient strength and durability to support the vessel in the upright condition regardless of vessel L/D ratio and must allow the complete exterior to be visually inspected by Department of Transportation (D.O.T.) retesters. Such a device should make composite pressure vessels available widespread use in applications where flat bottoms are a requirement, such as the medical industry.

SUMMARY OF THE INVENTION

This invention relates to a lightweight cylindrical composite pressure vessel with a flat bottom, to maintain the cylinder in the upright position. This invention provides a low profile flat base that can be a permanent part of the cylinder, or can be removable, depending on the application. This invention is based on the design philosophy of not exposing the flat bottom to the internal pressure. This design approach utilizes the high performance factor known in the art of composite pressure vessel design by retaining the radiused shape of the bottom dome. This optimum shape in relation to the filament winding angle allows for an optimum in structural efficiency. Therefore, this invention does not compromise structural efficiency and results in an extremely lightweight flat bottom composite cylinder. The flat bottom of this invention is acting only to support the cylinder in the upright position and is isolated from the internal pressure of the vessel. This approach is possible by the provision of a specially configured polar base support component piece that is attached to one end of the cylinder.

The polar base support piece has unique features and services multiple functions in the manufacturing process. One unique feature is that of a knurled O.D. surface which locks into the composite material during the filament winding process. This mechanical lock between the support piece and the cured composite material resists torsional loads applied to the support piece during the installation of the low profile flat bottom base, if a threaded connection is used, such as for a removable low profile base application. Another unique feature is an angular lip of the support piece to resist possible tensile loads. A further feature is a stepped cut-out on the support piece O.D. which locks it into the cured composite material and serves to resist compressive loads or impact loads to the base itself. These features mechanically lock the support piece into a permanent position to resist torsional, bending, compressive and tensile loads. The support piece forms a connection to the low profile base itself. This connection could be of several types depending on the application (permanent or removable base).

If a permanent low profile base is required, a barbed or locking snap-on configuration may be used on both the support piece and base. If a removable low profile base is required, a threaded configuration may be used as illustrated. The support piece serves a useful function in the manufacturing processes in that it may be used as a center on which the cylinder may rotate during the filament winding and intermediate curing processes.

Another advantage of this invention is the low profile base design. Due to the structural attributes of the support piece as discussed above, this flat base design does not clamp to or on the composite material. Potentially damaging fluids cannot be trapped between the low profile base and composite material O.D. This base design does not abrade or damage the composite O.D. like a mechanical clamp base as the O.D. would. Also, it leaves the entire cylinder surface exterior visible for the inspection as required by D.O.T. retesters.

Another advantage of this invention is economic. Currently, certain heavy steel and aluminum cylinders are long in comparison to their O.D. (high L/D ratio). These cylinders are subject to tipping over. Therefore, it is common practice to use an additional base device clamped to the cylinder bottom to increase its bottom diameter for increased stability. This device could be eliminated completely by this invention due to the lightweight nature of the cylinder in combination with a large diameter base to provide stability for high L/D ratio cylinders.

It is accordingly an important object of the invention to provide a flat bottom support for filament wound tanks that maintains the integrity of the filament wound design.

A further object of the invention is the provision of a retainer piece that may be integrally formed or attached during the winding of the pressure container and one that is specially configured to provide strength of support without compromising the integrity of the container.

A still further object of the invention is the provision of a flat bottom-type support or composite or filament wound pressure vessel that provides versatility in the utilization of such pressure vessels.

Other objects and advantages of the invention will be apparent from the following description, the accompanying drawings and the appended claims.

DETAILED DESCRIPTION OF THE PREFERRED EMBODIMENT

Figure 1:
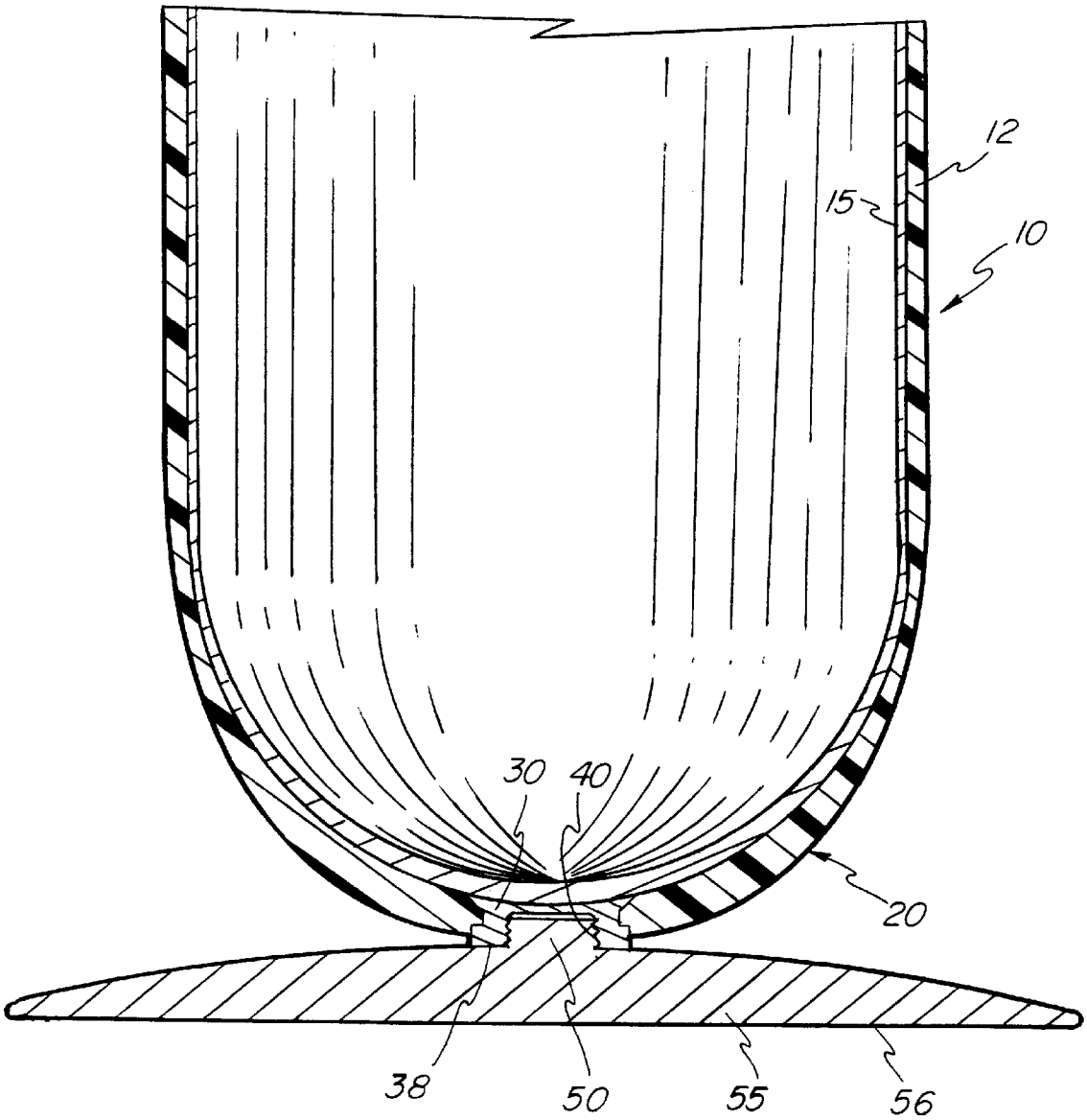
FIG. 1 is a partial cross-sectional view of a cylindrical composite pressure vessel with a flat bottom constructed according to this invention.

Referring to the figures of the drawing which represent a preferred embodiment of the invention, the lower end of a lightweight cylindrical composite pressure vessel is illustrated generally at 10 in FIG. 1. The pressure vessel may be configured to hold either liquid or gas under high pressure, such as up to 10,000 psi or more. It is illustrated as a lined pressure vessel, in which a wall or body 12 is formed of composite material, such as a filament winding, which encloses a gas or liquid impervious lining 15. The lining 15 may be metal, such as aluminum, or a plastic such as PET which has been blow molded into position. Such a pressure vessel is formed with generally hemispherical closed polar ends, such as the lower end illustrated generally at 20. It is well known that such configurations provide the highest degree of strength-to-weight ratio.

Figure 2:
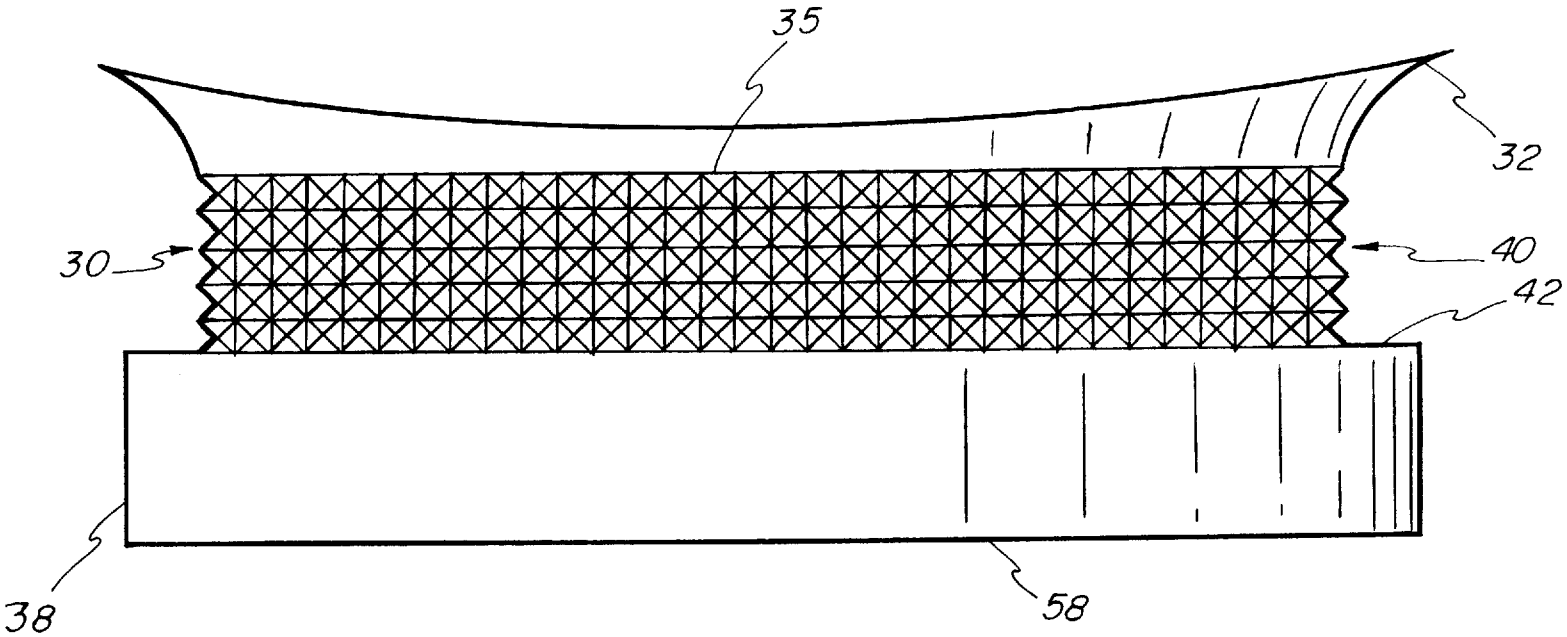
FIG. 2 is an enlarged elevational view of the polar boss piece as shown in FIG. 1.

This invention provides an arrangement by which a cylindrical composite pressure vessel, such as the filament wound vessel 10, may be provided with a flat bottom without disturbing the integrity of the pressure vessel, and without compromising its structural efficiency. To this end, a polar base support piece of boss 30 (FIG. 2) is configured to be captured and partially encapsulated between an outside surface the domed end of the liner 15 and the body 12, during winding. Thus, the polar boss 30 is formed with an annular skirt 32 which defines an inside closed cup-shaped surface 35 configured to conform to and be positioned directly against the outside surface of the liner 15 at the end 20. The boss 30 is circularly undercut between the lip and an outside face edge or end 38 to form an annular recess or stepped portion 40 providing a space into which the winding filaments may be wound and locked during the winding process. The outer annular surface is the recess 40 is knurled as shown in FIG. 2. During winding, the skirt 32 is overlapped by the filament winding layers making up the body 12, which filament winding layers are wound directly into the knurling of the annular recess 40 and against the generally radially extending ledge 42 separating the edge or end 38 from the recess 40. Such an arrangement integrally locks the boss 30 with the polar end 20 of the cylinder 10 and provides a support member that is mechanically locked in place, and one which resists torsional and bending loads and which spreads these loads out over a substantial portion of the polar end.

The exposed end 38 is internally and centrally tapped with a blind opening 48, in a preferred embodiment, to receive a threaded stud portion 50 of a base 55 as shown in FIG. 1. The base 55 has a flat bottom 56 and the stud portion 50 thereof is threaded into the threaded opening 48 firmly against the flat outside surface 58 of the boss 30 and thereby provides a support platform for the cylinder 10. In this manner, the cylinder 10 is supported by the platform of the base 55 in an upright position with its central axis generally normal to the plane of the flat bottom 56.

It will be seen that the arrangement provides an extremely low profile support base for a composite pressure cylinder. There is nothing clamped or otherwise provided to engage around the composite material for the purpose of supporting the pressure vessel. The regions between the support base 55 and the cylinder body 12 are open and free of any region that would tend to accumulate or trap liquids or dirt. Further, the arrangement is one in which the entire exterior surface of the pressure vessel itself is unobstructed and open for visual inspection, as may be required.

While a threaded connection is shown between the base 55 and the polar boss 30, it will be understood that other types of connections, either permanent or semi-permanent may be used. Further, the arrangement permits the body of the cylinder to be supported for example, in an installation by suitable attachment to the boss 30, such as for overhead storage or for other purposes.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A lined composite pressure vessel for mounting in an upright position on a flat surface or the like, comprising a filament wound wall having a polar closed end and having a liner therein, an end boss formed with a skirt positioned adjacent to an outside surface of such liner at said polar end, and said boss having a generally axial portion extending from said liner, said filament wound wall encapsulating said skirt and said axial portion, a face portion of said boss being positioned exteriorly of said closed end, and a support platform mounted at the face portion of said end boss by which said pressure vessel may be supported with its cylindrical body on a generally vertical axis.

2. A lined composite pressure vessel for mounting in an upright position on a flat surface or the like, comprising a generally cylindrical filament would wall having polar generally hemispherical closed ends, an end boss formed with an annular skirt positioned against a surface of the vessel liner at one of said polar ends, and said boss having a generally axial portion extending from said skirt, said filament wound wall encapsulating said skirt, with said axial portion extending outwardly through said wall, said axial portion having formed, on its outer surface, an undercut annular recess joining said skirt and configured to receive winding filaments of said wall therein such that said boss is mechanically locked in place by winding filaments which overlie said skirt and which extend into said recess, a face portion of said boss being positioned exteriorly of said one hemispherical closed end, said face portion being provided with means for receiving a portion of a support platform by which said pressure vessel may be supported with its cylindrical body on a generally upright position.

3. The pressure vessel of claim 2 in which said boss, at said recess, is provided with surface knurling forming an interlock with the filament windings of said wall.

4. A composite pressure vessel having a filament wound wall and having means for supporting such pressure vessel in a pre-determined oriented position with respect to a polar end of such vessel, comprising an end boss, said end boss having a skirt portion positioned inside the filament wound polar end of said vessel, said end boss having a generally axial portion extending from said skirt portion through said filament wound wall at said polar end with filaments of said wall being tightly wound about said axial portion, and a support platform fixed to said boss exteriorly of said filament wound wall for supporting said pressure vessel in said predetermined oriented position.

* * * * *